US008655198B2

(12) United States Patent
Yamane et al.

(10) Patent No.: US 8,655,198 B2
(45) Date of Patent: Feb. 18, 2014

(54) IMAGE FORMING APPARATUS AND TONER CARTRIDGES WITH DIFFERENTLY SIZED GUIDED PORTIONS

(75) Inventors: Masayuki Yamane, Kanagawa (JP); Kunihiro Ohyama, Tokyo (JP); Takeshi Uchitani, Kanagawa (JP); Yasufumi Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 144 days.

(21) Appl. No.: 13/304,476

(22) Filed: Nov. 25, 2011

(65) Prior Publication Data

US 2012/0141169 A1 Jun. 7, 2012

(30) Foreign Application Priority Data

Dec. 6, 2010 (JP) ..... 2010-271878
Nov. 8, 2011 (JP) ..... 2011-244129

(51) Int. Cl.
*G03G 15/00* (2006.01)
*G03G 15/08* (2006.01)

(52) U.S. Cl.
USPC ..... 399/12; 399/258

(58) Field of Classification Search
USPC ..... 399/12, 258
See application file for complete search history.

(56) References Cited

U.S. PATENT DOCUMENTS 4,611,899 A * 9/1986 Kasamura et al. ..... 399/12
7,184,691 B2 2/2007 Kita et al.
7,295,796 B1 11/2007 Murakami et al.
7,515,856 B2 4/2009 Ohyama
7,574,162 B2 8/2009 Yamane
7,577,379 B2 8/2009 Kita et al.
7,702,262 B2 4/2010 Taguchi et al.
7,706,699 B2 4/2010 Taguchi et al.
7,720,417 B2 5/2010 Taguchi et al.
7,796,922 B2 9/2010 Ohyama et al.
7,822,371 B2 10/2010 Taguchi et al.
7,826,777 B2 11/2010 Taguchi et al.
7,835,675 B2 11/2010 Taguchi et al.
7,853,183 B2 12/2010 Taguchi et al.
7,853,184 B2 12/2010 Taguchi et al.
7,962,069 B2 6/2011 Kurenuma et al.

(Continued)

FOREIGN PATENT DOCUMENTS

JP 2003-84534 3/2003
JP 2003084534 A * 3/2003

(Continued)

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

An image forming apparatus includes an image forming unit, a toner container mount, first and second toner containers removably insertable into the toner container mount horizontally, container guides formed in toner container mount to guide lateral side portions of the first and second toner containers, respectively, and an insertion opening forming member positioned defining first and second insertion openings through which the first and second toner containers are inserted, each including a laterally projecting portion. The second toner container is greater than the first toner container in cross section perpendicular to a direction of insertion, and the second insertion opening is greater than the first insertion opening. The first and second toner containers include guided portions projecting laterally, and the guided portion of the first toner container has a vertical length longer than that of the guided portion of the second toner container.

7 Claims, 8 Drawing Sheets

(56) References Cited

U.S. PATENT DOCUMENTS

| | | | | |
|---|---|---|---|---|
| 7,962,071 | B2 | 6/2011 | Tsuda et al. | |
| 7,991,334 | B2 | 8/2011 | Taguchi et al. | |
| 8,068,770 | B2 | 11/2011 | Kurenuma et al. | |
| 2007/0160394 | A1 * | 7/2007 | Taguchi et al. | 399/262 |
| 2007/0212119 | A1 * | 9/2007 | Kurenuma et al. | 399/262 |
| 2009/0226221 | A1 | 9/2009 | Takahashi | |
| 2009/0317140 | A1 | 12/2009 | Yoshida et al. | |
| 2010/0226690 | A1 | 9/2010 | Kadota et al. | |
| 2011/0008075 | A1 | 1/2011 | Taguchi et al. | |
| 2011/0020017 | A1 | 1/2011 | Takahashi | |
| 2011/0058858 | A1 | 3/2011 | Fukuda et al. | |

FOREIGN PATENT DOCUMENTS

| | | | |
|---|---|---|---|
| JP | 2006-209060 | | 8/2006 |
| JP | 2007-178969 | | 7/2007 |
| JP | 2008-134524 | | 6/2008 |
| JP | 2008134524 A | * | 6/2008 |

* cited by examiner

IMAGE FORMING APPARATUS AND TONER CARTRIDGES WITH DIFFERENTLY SIZED GUIDED PORTIONS

CROSS-REFERENCE TO RELATED APPLICATIONS

This patent application is based on and claims priority pursuant to 35 U.S.C. §119 to Japanese Patent Application Nos. 2010-271878, filed on Dec. 6, 2010, and 2011-244129, filed on Nov. 8, 2011, in the Japan Patent Office, the entire disclosure of each of which is hereby incorporated by reference herein.

FIELD OF THE INVENTION

The present invention generally relates to an image forming apparatus, such as a copier, a printer, a facsimile machine, or a multifunction machine having at least two of these capabilities, that uses a set of toner containers, and a set of toner containers for used in an image forming apparatus.

BACKGROUND OF THE INVENTION

Multicolor image forming apparatuses such as multicolor printers or multicolor copiers typically include multiple toner containers for containing different color toners. For example, JP-2006-209060-A, JP-2003-084534-A, JP-2007-178969-A, and JP-2008-134524-A (hereinafter respectively "first, second, third, and fourth patent documents") propose multicolor image forming apparatuses that include multiple image forming units to form different color toner images and a toner container mount in which multiple toner containers containing different color toners are removably installed.

In configurations in which multiple toner containers containing different color toners can be separately installed or removed from the image forming apparatus, when one of the multiple toner containers becomes empty, only the empty toner container can be replaced, thus facilitating replacement of toner containers.

In multicolor image forming apparatuses, generally, consumption of black toner is greater than consumption of any other toners (i.e., yellow, magenta, and cyan toners). Accordingly, it is common that the black toner container is larger in size than toner containers for other colors.

Additionally, in such multicolor image forming apparatuses, if a wrong toner container containing toner of a different color from an intended color is erroneously installed in the toner container mount, different color toners are mixed.

In view of the foregoing, various preventives are tried against erroneous installation of toner containers. For example, in the above-mentioned first patent document, the shape of an engagement portion of the toner container and an engagement portion of the toner container mount that engages the engagement portion of the toner container is different among the different colors to prevent erroneous installation of toner containers.

Additionally, the above-mentioned second, third, and fourth patent documents propose configurations in which toner containers are horizontally inserted and removed from the main body of the image forming apparatus, and each toner container includes a projection projecting from a side surface of the toner container perpendicular to the direction in which the toner container is inserted for preventing erroneous installation. More specifically, the projections for preventing erroneous installation are different in position or shape among different colors. If users try to install the toner container in a wrong portion of the toner container mount, the projection formed on the side of the toner container is blocked by the main body of the apparatus, thus preventing erroneous installation of the toner container. Consequently, the user can recognize that he or she is inserting the toner container into a wrong portion before the toner container reaches the position where the engagement portion of the toner container contacts the engagement portion of the apparatus.

BRIEF SUMMARY OF THE INVENTION

In view of the foregoing, one embodiment of the present invention provides an image forming apparatus including an image forming unit to form an image on an image bearer, a toner container mount, first and second toner containers for containing toner, removably insertable into the toner container mount horizontally, container guides formed in toner container mount to guide lateral side portions of the first and second toner containers inserted into the toner container mount, respectively, and an insertion opening forming member positioned at an entrance of the toner container mount, defining a first insertion opening through which the first toner container is inserted and a second insertion opening through which the second toner container is inserted. The second toner container is greater than the first toner container in cross section perpendicular to a direction of insertion of the first and second toner containers, and the second insertion opening is greater than the first insertion opening.

Each of the first and second insertion openings includes a laterally projecting portion, and a vertical length of the laterally projecting portion of the first insertion opening is longer than that of the laterally projecting portion of the second insertion opening. The first and second toner containers include guided portions projecting laterally on the cross section perpendicular to the direction of insertion of the first and second toner containers to fit in the laterally projecting portions of the first and second insertion openings, respectively. The guided portion of the first toner container has a vertical length longer than that of the guided portion of the second toner container.

Another embodiment provides a set of toner containers for containing different color toners for use in an image forming apparatus. The set of toner containers includes first and second toner containers horizontally insertable into a main body of the apparatus and including a guided portion projecting laterally on the cross section perpendicular to the direction of insertion thereof into the apparatus. The second toner container is greater than the first toner container on the cross section perpendicular to the direction of insertion, and the guided portion of the first toner container has a vertical length longer than that of the guided portion of the second toner container. First and second insertion openings are formed in the main body of the apparatus, and the first and second toner containers are insertable into the main body therethrough. The first and second insertion openings include laterally projecting portions to fit the guided portions of the first and second toner containers, respectively.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
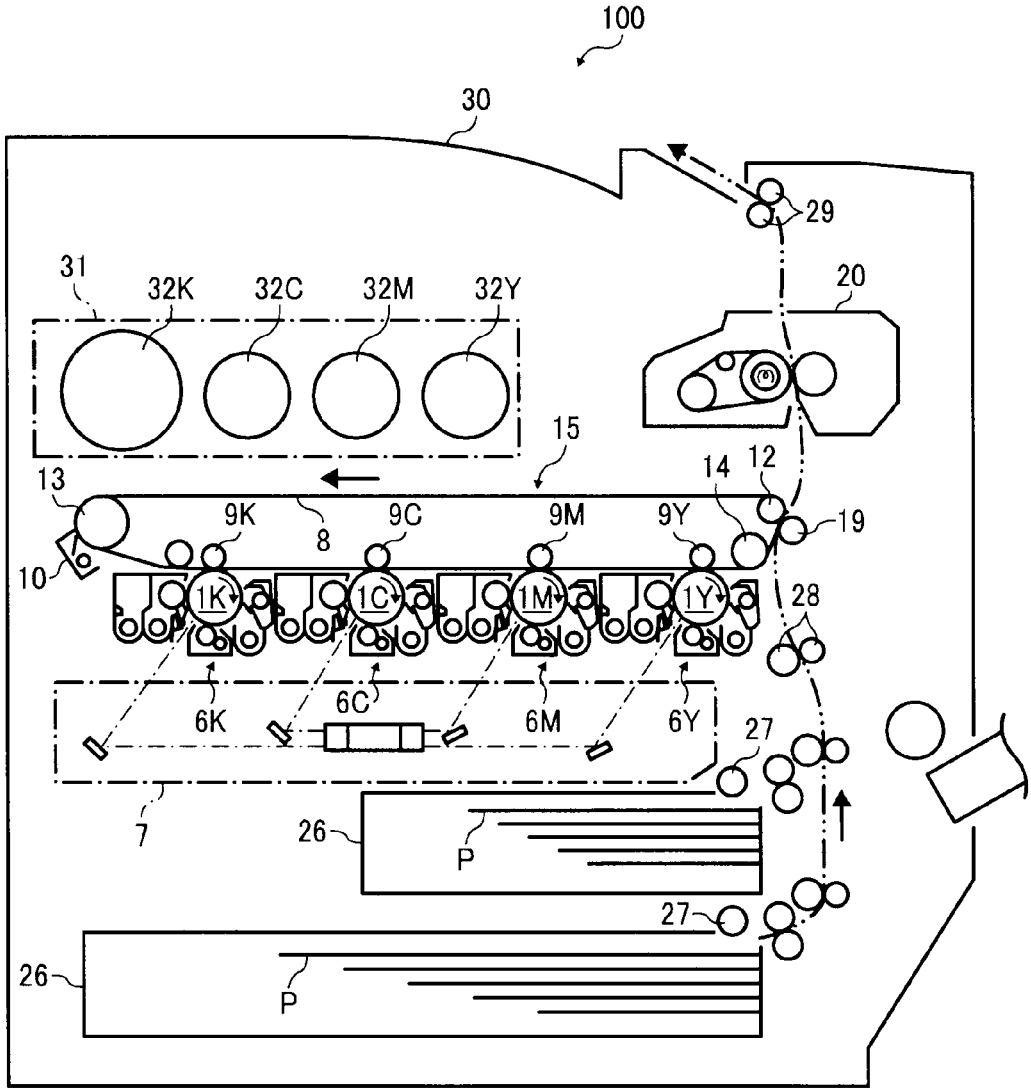
FIG. 1 is a schematic diagram illustrating an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a tandem-type multicolor image forming apparatus including multiple photoreceptors arranged in parallel, according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram illustrating a multicolor image forming apparatus 100 according to an embodiment of the present invention. The image forming apparatus 100 may be, for example, a laser printer.

As shown in FIG. 1, the image forming apparatus 100 includes a toner container mount 31, provided above a main body of the image forming apparatus 100. Four toner containers 32Y, 32M, 32C, and 32K (shown in FIG. 4) for containing yellow, magenta, cyan, and black toners, respectively, are removably installable in the toner container mount 31. That is, the toner containers 32Y, 32M, 32C, and 32K are replaceable.

An intermediate transfer unit 15 including an intermediate transfer belt 8 is provided beneath the toner container frame 31. Image forming units 6Y, 6M, 6C, and 6K respectively corresponding to yellow, magenta, cyan, and black are arranged in parallel, facing the intermediate transfer belt 8.

Figure 2:
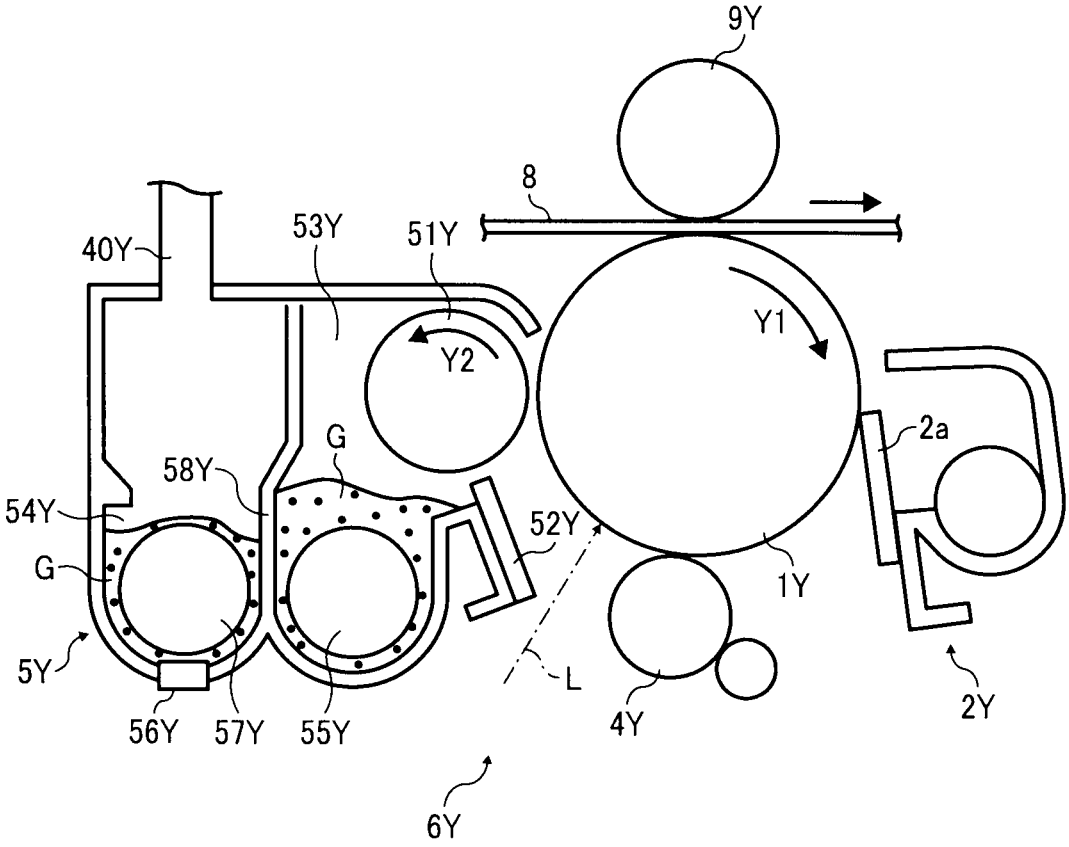
FIG. 2 is an enlarged end-on axial view of an image forming unit.

FIG. 2 is an enlarged end-on axial view of the image forming unit 6Y for yellow.

As shown in FIG. 2, the image forming unit 6Y includes a drum-shaped photoreceptor 1Y serving as an latent image bearer, and a charging roller 4Y serving as a charging member, a development device 5Y, and a cleaning unit 2Y are provided around the photoreceptor 1Y. The image forming unit 6Y includes a discharger. Image forming processes, namely, charging, exposure, development, transfer, and cleaning processes are performed on the photoreceptor 1Y, and thus a yellow toner image is formed on the photoreceptor 1Y.

It is to be noted that other image forming units 6M, 6C, and 6K have a similar configuration to that of the yellow image forming unit 6Y except the color of the toner used therein and form toner images of the respective colors. Thus, only the image forming unit 6Y is described below and descriptions of other image forming units 6 are omitted.

Referring to FIG. 2, the photoreceptor 1Y is rotated clockwise in FIG. 2 as indicated by arrow Y1 by a driving motor. A surface of the photoreceptor 1Y is charged uniformly at a position facing the charging roller 4Y by the charging roller 4Y (charging process).

When the photoreceptor 1Y reaches a position to receive a laser beam L emitted from an exposure unit 7 (shown in FIG. 1), the photoreceptor 1Y is scanned with the laser beam L, and thus an electrostatic latent image for yellow is formed thereon (exposure process).

Then, the photoreceptor 1Y reaches a position facing the development device 5Y, where the latent image is developed with toner into a yellow toner image (development process).

When the surface of the photoreceptor 1Y carrying the toner image reaches a position facing a primary-transfer bias roller 9Y via the intermediate transfer belt 8, the toner image is transferred therefrom onto the intermediate transfer belt 8 (primary-transfer process). After the primary-transfer process, a certain amount of toner tends to remain on the photoreceptor 1Y.

Then, a cleaning blade 2*a* of the cleaning unit 2Y mechanically collects any toner remaining on the photoreceptor 1Y (cleaning process) when the surface of the photoreceptor 1Y reaches a position facing the cleaning unit 2Y. Subsequently, the discharger removes electrical potentials remaining on the surface of the photoreceptor 1Y. Thus, a sequence of image forming processes performed on the photoreceptor 1Y is completed.

The above-described image forming processes are performed in the image forming units 6M, 6C, and 6K similarly to the yellow image forming unit 6Y. That is, the exposure unit 7 disposed above the image forming units 6 in FIG. 1 directs laser beams L according to image data onto the photoreceptors 1 in the respective image forming units 6. Specifically, the exposure unit 7 includes light sources to emit the laser beams L, multiple optical elements, and a polygon mirror that is rotated by a motor. The exposure unit 7 directs the laser beams L to the respective photoreceptors 1 via the multiple optical elements while deflecting the laser beams L with the polygon mirror.

Then, the toner images are formed on the respective photoreceptors 1 through the development process, transferred therefrom, and then superimposed one on another on the intermediate transfer belt 8. Thus, a multicolor toner image is formed on the intermediate transfer belt 8.

The intermediate transfer unit 15 includes four primary-transfer bias rollers 9, a secondary-transfer backup roller 12, a cleaning backup roller 13, a tension roller 14, and a belt cleaning unit 10 in addition to the intermediate transfer belt 8. The intermediate transfer belt 8 is supported by the secondary-transfer backup roller 12, the cleaning backup roller 13, and the tension roller 14, and one of these rollers (the secondary-transfer backup roller 12 in the configuration shown in FIG. 1) serves as a driving roller to rotate the intermediate transfer belt 8 counterclockwise in FIG. 1 as indicated by an arrow shown in FIG. 1.

Herein, the four primary-transfer bias rollers 9 are configured to press against the corresponding photoreceptors 1 via the intermediate transfer belt 8, and four contact portions between the primary-transfer bias rollers 9 and the corresponding photoreceptors 1 are hereinafter referred to as primary-transfer nips. Each primary-transfer bias roller 9 receives a transfer bias whose polarity is opposite the polarity of the toner.

While rotating in the direction indicated by the arrow shown in FIG. 1, the intermediate transfer belt 8 sequentially passes through the respective primary-transfer nips, and the toner images formed on the respective photoreceptors 1 are superimposed one on another on the intermediate transfer belt 8, forming a multicolor toner image thereon.

Then, the intermediate transfer belt 8 carrying the multicolor toner image reaches a position facing a secondary-transfer roller 19 disposed facing the secondary-transfer backup roller 12. The secondary-transfer backup roller 12 and the secondary-transfer roller 19 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process).

After the secondary-transfer process, a certain amount of toner tends to remain on the intermediate transfer belt 8. Then, the intermediate transfer belt 8 that has passed through the secondary-transfer nip reaches a position facing the belt cleaning unit 10, where any toner remaining on the intermediate transfer belt 8 is collected by the belt cleaning unit 10. Thus, a sequence of image forming processes performed on the intermediate transfer belt 8 is completed.

The sheet P is transported by a sheet feeder 26 provided in a lower portion of the image forming apparatus 100 to the secondary-transfer nip via a feed roller 27, and a pair of registration rollers 28.

More specifically, the sheet feeder 26 contains multiple sheets P piled one on another. The feed roller 27 rotates counterclockwise in FIG. 1 to feed the sheet P on the top of sheets contained in the sheet feeder 26 toward a nip formed between the registration rollers 28. The registration rollers 28 stop rotating temporarily, stopping the sheet P with a leading edge of the sheet P stuck in the nip therebetween. The registration rollers 28 resumes rotating to transport the sheet P to the secondary-transfer nip, time to coincide with the arrival of the multicolor toner image formed on the intermediate transfer belt 8. Thus, the multicolor toner image is recorded on the sheet P.

The sheet P carrying the multicolor toner image is sent to a fixing device 20. In the fixing device 20, a fixing roller and a pressing roller apply heat and pressure to the sheet P to fix the multicolor toner image on the sheet P.

Subsequently, the sheet P is discharged by a pair of discharge rollers 29 outside the image forming apparatus 100 and stacked as an output image on a stack tray 30 formed on an upper side of the apparatus body.

Thus, a sequence of image forming processes performed in the image forming apparatus 100 is completed.

Next, the development device 5Y included in the image forming unit 6Y is described below with reference to FIG. 2.

The development device 5Y includes a development roller 51Y serving as a developer bearer disposed facing the photoreceptor 1Y, and a casing of the development device 5Y is divided into a first developer containing compartment 53Y and second developer containing compartment 54Y for containing developer supplied to the development roller 51Y. The development device 5Y further includes a doctor blade 52Y, serving as a developer regulator disposed facing the development roller 51Y, and first and second conveyance screws 55Y and 57Y provided in the first and second developer containing compartments 53Y and 54Y, respectively. Each of the first and second conveyance screws 55Y and 57Y may be a conveyance screw including a rotary shaft with a spiral blade or multiple planar blades (fins), or an auger. The development device 5Y further includes a concentration detector 56Y to detect concentration of toner in the developer contained in the second developer containing compartment 54Y.

The development roller 51Y includes a magnet roller or multiple magnets fixed in position relative to the casing of the development device 5Y, a sleeve that rotates around the magnet roller, and the like. The first and second developer containing compartments 53Y and 54Y contain two-component developer G consisting essentially of carrier (carrier particles) and toner (toner particles).

A partition 58Y divides the first developer containing compartment 53Y from the second developer containing compartment 54Y partly, and openings (communication portions) are formed in both end portions of the partition 58Y in an axial direction of the first conveyance screw 55Y provided in the first developer containing compartment 53Y, perpendicular to the surface of the paper on which FIG. 2 is drawn. The first developer containing compartment 53Y communicates with the second developer containing compartment 54Y via the openings. Thus, the developer is circulated between the first developer containing compartment 53Y and the second developer containing compartment 54Y as the first and second conveyance screws 55Y and 57Y rotate.

Additionally, a supply opening is formed on an upper side of the second developer containing compartment 54Y, and the developer containing compartment 54Y communicates with a toner supply tube (toner supply path) 40Y through which toner is supplied from the toner container 32Y.

To form images, the sleeve of the development roller 51Y rotates in the direction indicated by arrow Y2 shown in FIG. 2. The developer G is carried on the development roller 51Y by the magnetic field generated by the magnets provided inside the sleeve, and the developer G is transported in the circumferential direction of the development roller 51Y as the sleeve rotates.

The ratio of the toner to the carrier (concentration of toner) in the developer G contained in the development device 5Y is adjusted within a predetermined range. More specifically, a toner supply device 59Y (shown in FIG. 3), described later, supplies toner from the toner container 32Y to the second developer containing compartment 54Y according to the consumption of toner in the development device 5Y.

The toner supplied to the second developer containing compartment 54Y is then mixed with the developer G and circulated, in the direction perpendicular to the surface of the paper on which FIG. 2 is drawn, between the two developer containing compartments 53Y and 54Y by the first and second conveyance screws 55Y and 57Y. While the developer G is thus agitated, toner particles in the developer G are charged with friction with carrier particles and adsorbed to the carrier particles. Then, the toner particles are carried on the development roller 51Y together with the carrier particles by a magnetic force generated on the development roller 51Y.

The development device 5Y configured as described above operates as follows.

The sleeve of the development roller 51Y rotates counterclockwise as indicated by arrow Y2 shown in FIG. 2. Then, the developer G is carried on the development roller 51Y by the magnetic field generated by the magnets provided inside the sleeve, and the developer G is transported in the circumferential direction of the development roller 51Y as the sleeve rotates.

The developer G carried on the development roller 51Y is transported as indicated by arrow Y2 in FIG. 2 to a position where the doctor blade 52Y faces the development roller 51Y. Then, the amount of the developer G on the development roller 51Y is adjusted to a suitable amount by the doctor blade 52Y, after which the developer G is carried to a development area facing the photoreceptor 1Y. Then, the toner in the developer G adheres to the latent image formed on the photoreceptor 1Y due to the effect of the magnetic field generated in the development area. As the sleeve rotates, the developer G remaining on the development roller 51Y reaches an upper part of the first developer containing compartment 53Y and then drops from the development roller 51Y.

Next, the toner supply device 59Y to supply the toner contained in the toner container 32Y to the development device 5Y is described in further detail below with reference to FIG. 3.

Figure 3:
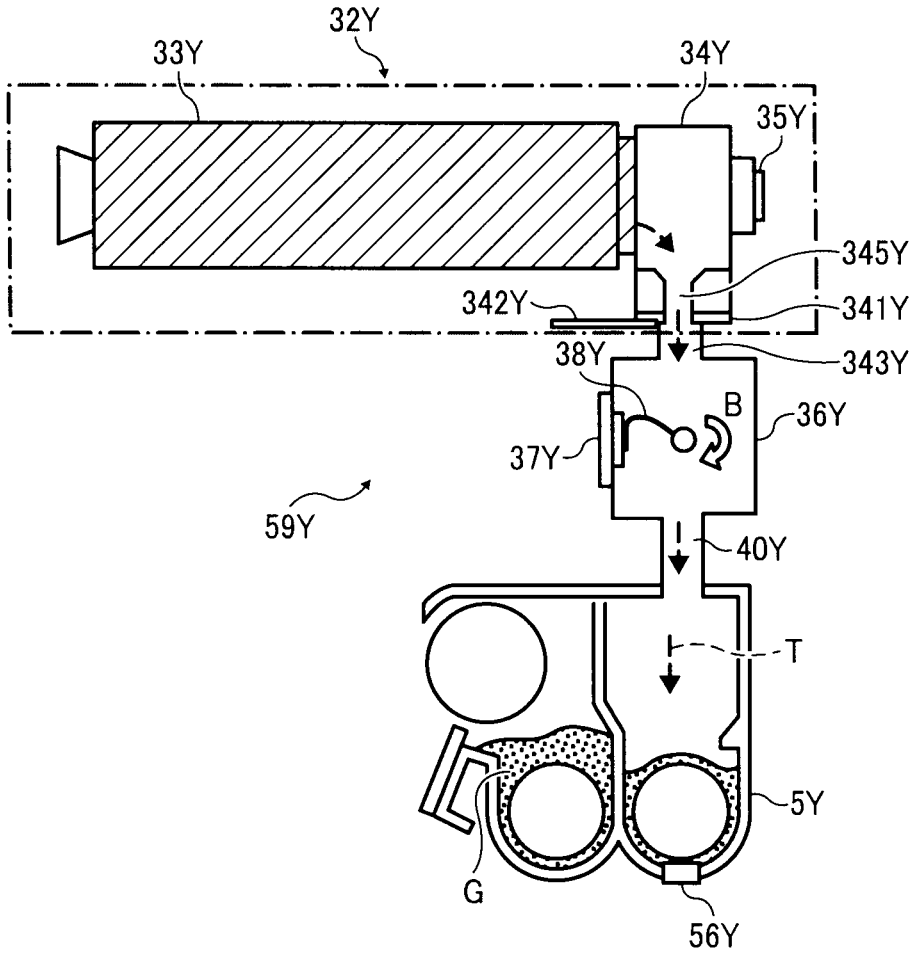
FIG. 3 illustrates a toner supply device to supply toner from a toner container to the image forming unit.

FIG. 3 illustrates the toner supply device 59.

It is to be noted that relative directions of the toner container 32Y, a toner reservoir 36Y, a toner supply path 343, and the development device 5Y shown in FIG. 3 are different from the present embodiment for ease of understanding. In the present embodiment, the long axis of the toner container 32Y is perpendicular to the surface of the paper on which FIG. 3 is drawn as shown in FIG. 1.

Figure 4:
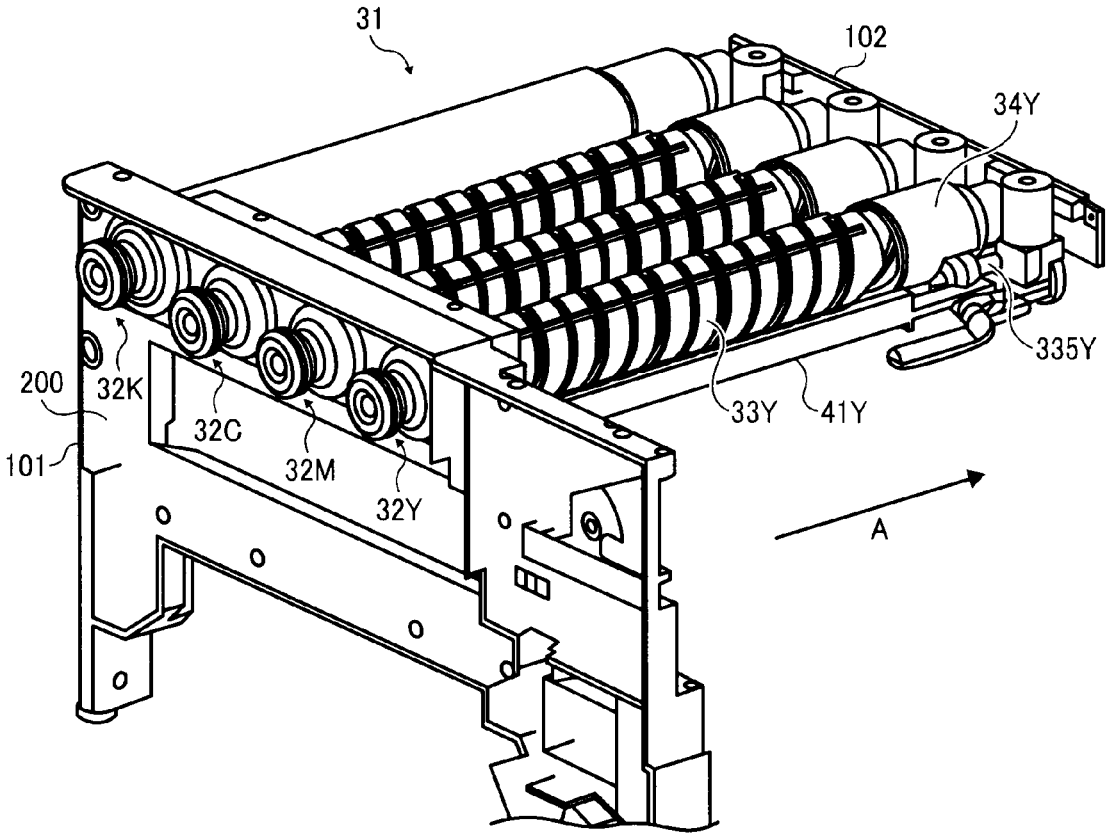
FIG. 4 is a perspective view illustrating a toner container mount in which four toner containers are mounted.

FIG. 4 is a perspective view illustrating the toner container mount 31 in which the four toner containers 32 are mounted.

Referring to FIG. 4, four guide rails 41 for the respective colors extend between a front plate 101 and a back plate 102 forming a housing of the image forming apparatus 100. A space above the four guide rails 41 and defined by the front plate 101 and the back plate 102 serves as the toner container mount 31.

The image forming apparatus 100 further includes an outer cover to cover the housing shown in FIG. 4, and the outer cover includes a front cover covering the front plate 101 that can open and close relative to the main body of the image forming apparatus 100. When the front cover is opened, an inner cover 200 provided on the front plate 101 is exposed.

The toner containers 32 are mounted in respective holders formed in the toner container mount 31 as shown in FIG. 4. The respective color toners are supplied therefrom through the toner supply paths 343, the toner reservoirs 36, and the toner supply paths 40 to the corresponding developing devices 5 according to the amount of the corresponding toner consumed. The toner supply path 343, the toner reservoir 36, and the toner supply path 40 are provided separately for each color. The four toner supply devices 59 have a similar configuration except the color of the toner used therein.

The toner container 32Y is horizontally installed in the main body of the image forming apparatus 100, in the direction perpendicular to the front plate 101 and the back plate 102 as indicated by arrow A shown in FIG. 4.

Additionally, as shown in FIG. 3, the toner container 32Y includes a container body 33Y and a head portion 34Y provided on the leading side of the container body 33Y in the direction of insertion. In the head portion 34Y, a slidable shutter 342Y is provided via a sponge seal member 341Y, and the toner container mount 31 includes a projection to move the shutter 342Y. When the toner container 32Y is set in the toner container mount 31 of the image forming apparatus 100, the shutter 342Y slides by the effect of the projection formed in the toner container mount 31. Thus, a toner discharge path (toner outlet 345Y) formed in the toner container 32Y is exposed.

Further, an electronic board (electronic data storage) 35Y, shown in FIG. 3, for storing data relating to the toner container 32Y is provided in an edge surface of the toner container 32Y on the leading side in the direction in which the toner container 32Y is inserted in the image forming apparatus 100 indicated by arrow A. When the toner container 32Y is set in the apparatus, the electronic board 35Y contacts an electronic data reader provided in the main body of the image forming apparatus 100, and data stored in the electronic board 35Y can be transmitted to a controller of the main body of the image forming apparatus 100.

As shown in FIGS. 1 and 4, the toner containers 32 are substantially cylindrical and removably installed in the respective holders formed in the toner container mount 31. It is to be noted that, when the respective service live of the toner containers 32Y, 32M, 32C, and 32K have expired, that is, when almost all toner in the toner container 32 have been consumed, the old one is replaced with a new one. The toner contained in each toner container 32 is supplied as required by the toner supply device 59 to the development device 5 of the corresponding image forming unit 6.

It is to be noted that, in the present embodiment, the toner container 32K for containing black toner, the consumption of which is greater than other colors, has a capacity greater than that of other toner containers 32Y, 32M, and 32C.

Figure 5:
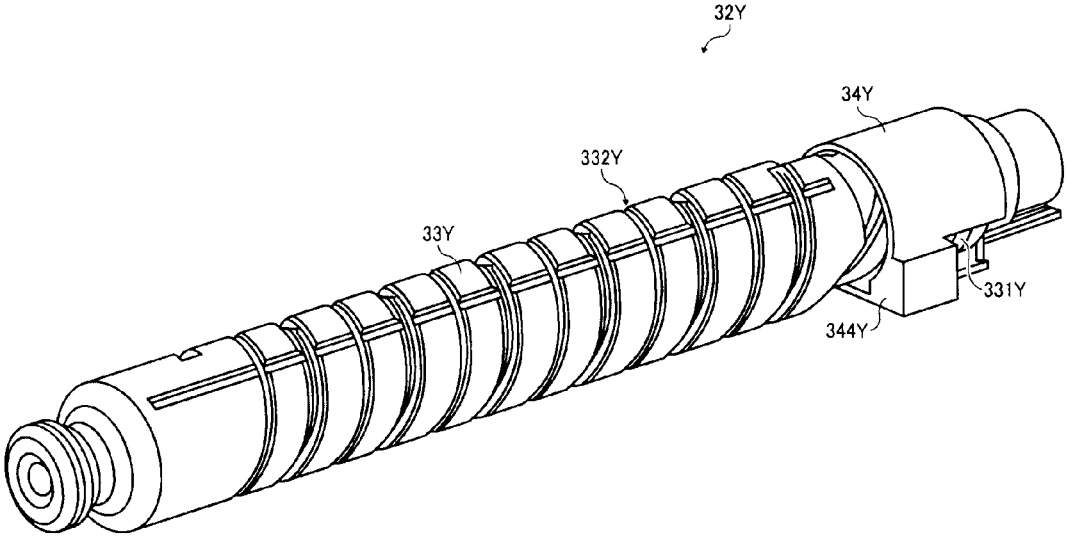
FIG. 5 is a perspective view illustrating a toner container containing yellow toner.

FIG. 5 is a perspective view illustrating the toner container 32Y containing yellow toner.

The toner containers 32 have a similar configuration, and thus only the toner container 32Y is described below with descriptions of other toner containers 32 omitted.

Referring to FIG. 5, the head portion 34Y is stationary relative to the image forming apparatus 100 and is connected thereto using, for example, a snap-fit structure and holds the container body 33Y rotatably. Thus, the head portion 34Y serves as a container body holder. Additionally, as shown in FIG. 3, the toner outlet 345Y to discharge the toner contained in the toner container 32Y, the sponge seal member 341Y, and the shutter 342Y to open and close the toner outlet 345Y are formed on the bottom side of the head portion 34Y. The head portion 34Y further includes guided portions 344 projecting laterally in the direction perpendicular to the direction of insertion as shown in FIG. 5.

The container body 33Y includes a container gear 331Y shown in FIG. 5, provided on the leading end portion thereof in the direction of insertion. The container gear 331Y rotates together with the container body 33Y. The toner container mount 31 includes a drive gear 335Y shown in FIG. 4 that engages the container gear 331Y. With this configuration, when a motor rotates the drive gear 335Y engaging the container gear 331Y, the container body 33Y rotates.

Additionally, a spiral protrusions 332Y (shown in FIG. 5) protruding inward is formed on an inner circumferential face of the container body 33Y. In other words, a spiral groove is formed in an outer circumferential surface of the toner container 33Y when viewed from outside as shown in FIG. 5. The spiral protrusion 332Y is for transporting the toner inside the container body 33Y and discharging the toner through the toner outlet 345Y formed in the head portion 34Y with rotation of the container body 33Y in a predetermined direction. The container body 33Y and elements, such as the container gear 331Y, provided on the circumferential surface of the container body 33Y can be produced as a single unit through blow molding. Although the container body 33Y and the head portion 34Y are connected together with a snap-fit structure in the present embodiment, an edge face of the container body 33Y is pressed against a seal member provided on the head portion 34Y to prevent leakage of toner. The seal member can be, for example, foamed polyurethane elastomer (PUR).

In FIG. 3, the toner flows in the direction indicated by broken arrow T. As the container body 33Y rotates, the toner discharged from the container body 33Y falls under the gravity and is discharged through the toner supply path 343Y to the toner reservoir 36Y. The toner reservoir 36Y includes a piezoelectric sensor 37Y and a cleaner 38Y to clean the surface of the piezoelectric sensor 37Y. The cleaner 38Y rotates in the direction indicated by arrow B shown in FIG. 3 and removes toner from the surface of the piezoelectric sensor 37Y with, for example, a thin polyethylene terephthalate (PET) member.

Additionally, a rotary toner conveyance member, such as a screw, agitator, or rotary shaft and multiple blades, is provided in the toner supply path 40Y provided between the toner reservoir 36Y and the development device 5Y. Driving of the toner conveyance member is controlled according to feedback values from the concentration detector 56Y to maintain a desirable concentration of toner in the developer G. Alternatively, the toner conveyance member provided in the toner supply path 40Y may be an auger without a center axis.

The piezoelectric sensor 37Y provided in the toner reservoir 36Y can detect presence of toner at the position where the piezoelectric sensor 37Y is provided. Thus, the piezoelectric sensor 37Y can detect that the level of the toner remaining in the toner reservoir 36Y is below a predetermined level. When no toner or almost no toner remains in the toner container 32Y, toner is not supplied to the toner reservoir 36Y, and the piezoelectric sensor 37Y detects that no toner is present at the position where the piezoelectric sensor 37Y is provided. Then, the image forming apparatus 100 can alert the user to prompt the user to replace the toner container 32.

Because toner still remains in the toner supply path 40Y at that time, the concentration of toner in the developer G can be kept at proper level, securing the quality of images formed by the image forming apparatus 100, even when toner container 32Y is thus empty.

Alternatively, a configuration in which toner is supplied from the toner discharge path formed in the head portion 34Y directly to the development device 5Y without temporarily stored in the toner reservoir 36Y can be used. This configuration can reduce the number of components, thus reducing the cost substantially. In this case, it is necessary to detect whether toner is present in the toner container 32Y. For example, toner consumption can be estimated from the number of pixels printed based on the relation between image area and toner consumption acquired in advance.

Next, insertion of the toner container 32 into the main body of the image forming apparatus 100 is described below.

Figure 6:
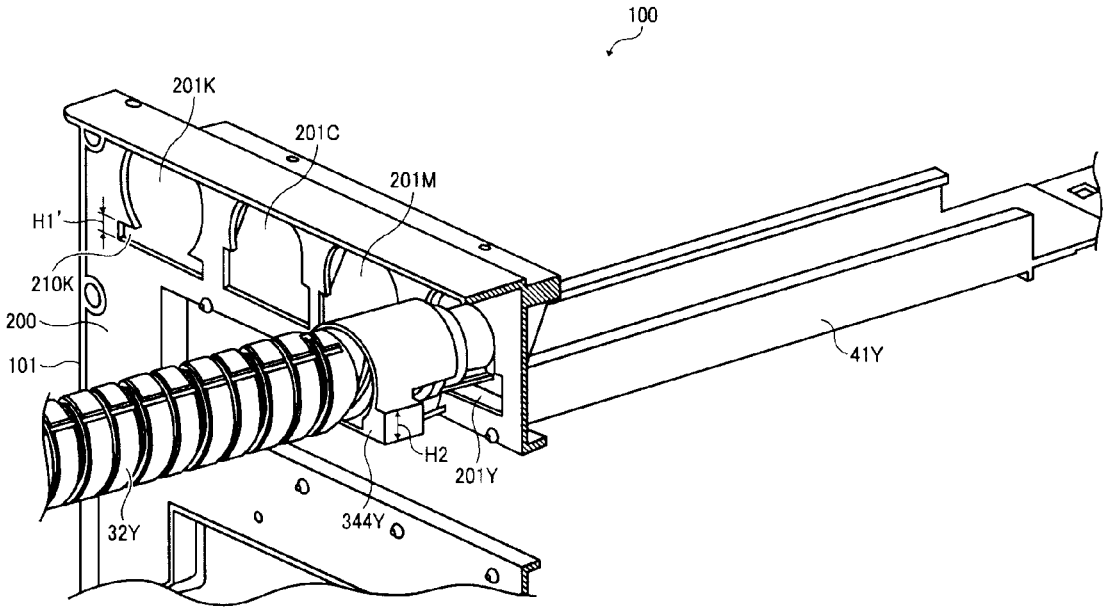
FIG. 6 illustrates installation of a toner container into a main body of the image forming apparatus.

FIG. 6 illustrates installation of the toner container 32 into the main body of the image forming apparatus 100. The inner cover 200 is provided on the front plate 101 positioned on the front side of the image forming apparatus 100 to cover the image forming mechanism inside the main body. The image forming apparatus 100 may includes a cover dedicated for the toner supply devices 59.

Four openings 201 are formed in the inner cover 200 for insertion of the respective toner containers 32. That is, the inner cover 200 serves as an insertion opening forming member and defines the four openings 201 through which the toner containers 32 are inserted. The four openings 201 are larger than the shapes of the respective toner containers 32 projected in the direction of insertion of the toner containers 32. Additionally, the openings 201 respectively include portions 210 projecting laterally perpendicular to the direction of insertion of the toner containers 32, corresponding to the guided portions 344.

The opening 201Y, which is the first from the right in FIG. 6, is for insertion of the toner container 32Y for yellow, capacity of which is smaller among the four colors. Thus, the opening 201Y is greater than the shape of the toner container 32Y projected in the direction of insertion thereof, that is, on the cross section perpendicular to the direction of insertion.

By contrast, the opening 201K, which is the first from the left in FIG. 6, is for insertion of the toner container 32K for black, capacity of which is greater among the four colors. The opening 201K is greater than the shape of the toner container 32K projected in the direction of insertion thereof and is sufficiently greater than the opening 201Y.

The toner containers 32M and 32C for magenta and cyan have an identical or similar capacity to that of the toner container 32Y for yellow. The openings 201M and 201C positioned inner side among the four openings 201 and the opening 201Y are identical or similar in size.

On the back of the inner cover 200, the guide rails 41 that extend entirely to the positions where the respective toner containers 32 are set are provided. It is to be noted that only the guide rail 41Y is shown in FIG. 6 for simplicity. When the toner container 32Y is inserted into the image forming apparatus 100, the guided portions 344Y engage with the guide rails 41Y, and an upper bent portion of the guide rails 41Y can prevent the toner container 32Y from floating during the insertion process.

It is to be noted that, in FIG. 6, reference characters H1' represents a height of the laterally projecting portion 210K of the opening 201K through which the guided portion 344K formed on the head portion 34K of the toner container 32K passes through the opening 201K, and H2 represents a height of the guided portions 344Y, 344M, and 344C formed on the head portions 34Y, 34M, and 34C of the toner containers 32Y, 32M, and 32C.

Next, prevention of erroneous installation of toner containers is described below.

In configurations in which the capacity of the black toner container 32K is greater than other color toner containers 32, the following inconveniences might occur in terms of prevention of erroneous installation.

Increasing the capacity of the black toner container 32K makes the cross-sectional area of the black toner container 32K perpendicular to the direction of insertion greater than that of the other toner containers 32. Accordingly, the opening 201K through which the black toner container 32K is inserted into the apparatus body increases in size. Therefore, even if the projections for preventing erroneous installation among different colors are provided on the toner containers 32, it is possible that the opening 201K through which the black toner container 32K is inserted is greater than the cross section including the projection of the toner containers 32 for other colors. In such a case, it is possible that the user mistakenly inserts the smaller toner containers 32 for containing other color toners through the opening 201K formed in the toner container mount 31, dedicated for the black toner container 32K. Then, the user has to pull out the toner container 32 once inserted into the wrong portion in the toner container mount 31. Additionally, if the toner outlet formed in the toner container 32 is brought close to the toner inlet formed in the apparatus, different color toners can be mixed, which degrades image quality.

A projection dedicated for color compatibility for preventing erroneous installation may be formed on the smaller toner containers 32 so that the projection does not fit but is blocked by the opening 201K for the black toner container 32K. At present, however, the interval between the adjacent toner containers 32 is reduced to respond to increasing demand for more compact image forming apparatuses, and it is difficult to provide such a projection dedicated for color discrimination in the width direction of the apparatus perpendicular to the direction of insertion.

In view of the foregoing, the present embodiment is configured to prevent erroneous installation of smaller toner containers 32 into the portion dedicated for the larger toner container 32K in the toner container mount 31 without increasing in the lateral size of the apparatus.

Figure 7:
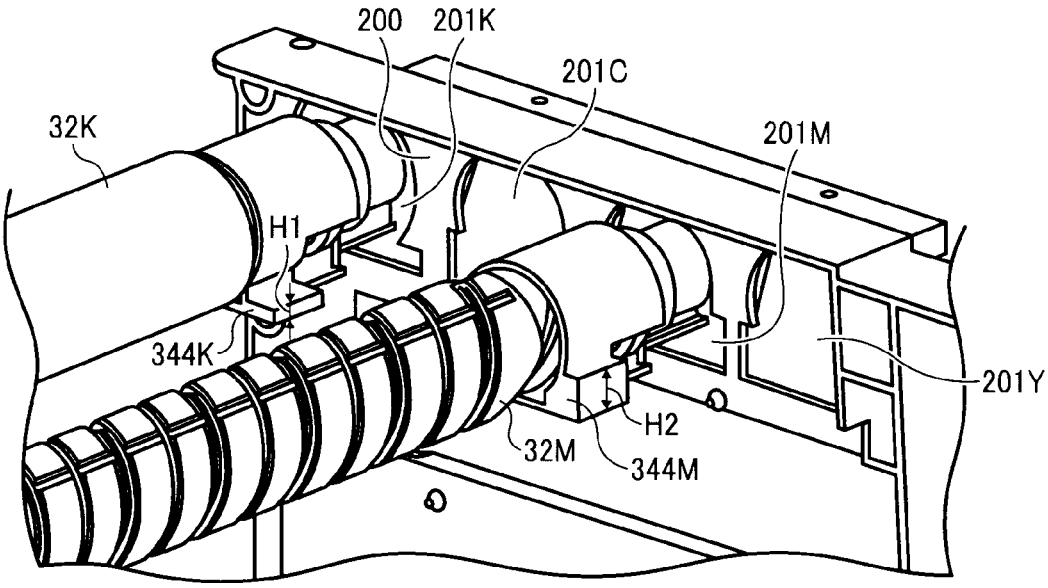
FIG. 7 illustrates installation of a smaller toner container and a larger toner container.

FIG. 7 illustrates installation of one of the smaller toner containers 32Y, 32M, and 32C and the larger toner container 32K.

It is to be noted that, in FIG. 7, reference character H1 represents a height of the guided portion 344K formed on the head portion 34K of the toner container 32K.

Needless to say, the cross section of the toner containers 32Y, 32M, and 32C whose capacity is smaller, perpendicular to the direction of insertion of the toner containers 32 has an external diameter smaller than that of the cross section of the toner container 32Y whose capacity is greater, perpendicular to the direction of insertion of the toner containers 32. Accordingly, the container body 33Y, 33M, or 33C alone can be inserted through the opening 201K for the toner container 32K whose capacity is greater than the other toner containers 32.

However, the toner containers 32 used in the image forming apparatus 100 according to the present embodiment include the head portion 34 on the leading side in the direction of insertion thereof, and the head portion 34 includes the above-described guided portions 344.

In the present embodiment, as shown in FIGS. 6 and 7, the height H2 of the guided portions 344Y, 344M, and 344C of the smaller toner containers 32Y, 32M, and 32C is greater than the height H1 of the guided portions 344K of the larger toner container 32K and is greater than the height H1' of the laterally projecting portions 210K of the opening 201K that fit the guided portions 344K of the black toner container 32K. This configuration can prevent the user from erroneously installing the smaller toner container 32Y, 32M, or 32C through the opening 201K dedicated for the larger toner container 32K.

It is preferable that the guided portions 344 be positioned close to the leading end of the toner container 32 in the direction of insertion thereof so that the user can recognize erroneous installation early.

Although erroneous installation of toner containers may be prevented in configurations in which the engagement portions between the toner containers and the toner container mount are different in shape among different colors, the user does not recognize erroneous installation until the wrong toner container is inserted to the position where its engagement portion contacts the engagement portion of the toner container mount. Moreover, the user has to pull out the toner container that has been substantially inserted into the apparatus. By contrast, in the present embodiment, the guided portions 344 are positioned on the leading side of the toner containers 32 in the direction of insertion. Therefore, the user can recognize erroneous installation early. This configuration can save the user from pulling out the toner container 32 once inserted and prevent mixing of different color toners, which is caused when the toner outlet of the toner container 32 is brought close to the toner inlet of the apparatus.

In the configuration described above with reference to FIGS. 1 and 7, the guided portions 344 are provided on either lateral side of the toner container 32. Alternatively, the guided portion 344 may be provided on only one side of the toner container 32 to make the image forming apparatus 100 more compact. Sufficient guide can be attained similarly even if the guided portion 344 is provided on only one side, and this configuration can reduce the intervals between the adjacent toner containers 32. Thus, the main body of the image forming apparatus 100 can be more compact.

Figure 8:
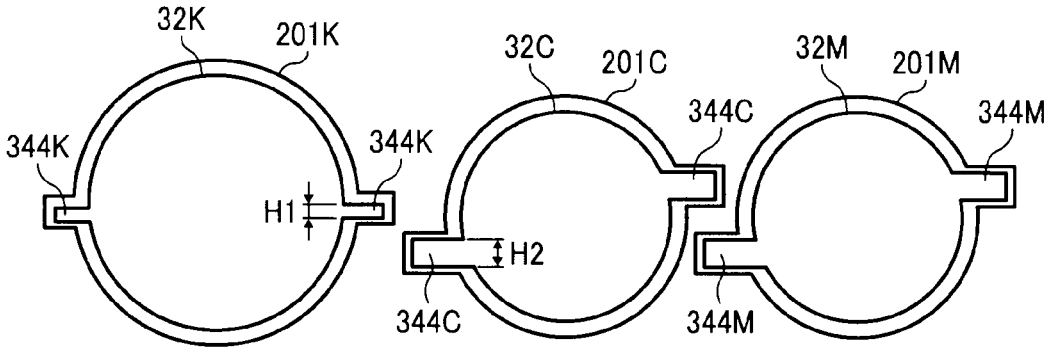
FIG. 8 illustrates the relation between insertion openings and toner containers including guided portions provided on both lateral sides at different heights.

FIG. 8 illustrates the relation between the toner containers 32 and the openings 201 in a configuration in which the guided portions 344 are provided on both lateral sides of the toner containers 32, and vertical positions of the guided portions 344 provided on both lateral sides of the smaller toner containers 32Y, 32M, and 32C are different. To attain compactness of the image forming apparatus 100 while providing the guided portions 344 on both sides of the toner container 32 for more reliable guide for insertion, the guided portions 344 can be provided at different heights as shown in FIG. 8. Providing the right and left guided portions 344 at different vertical positions can reduce the interval between the adjacent toner containers 32, thus reducing the size of the image forming apparatus 100.

Figure 9:
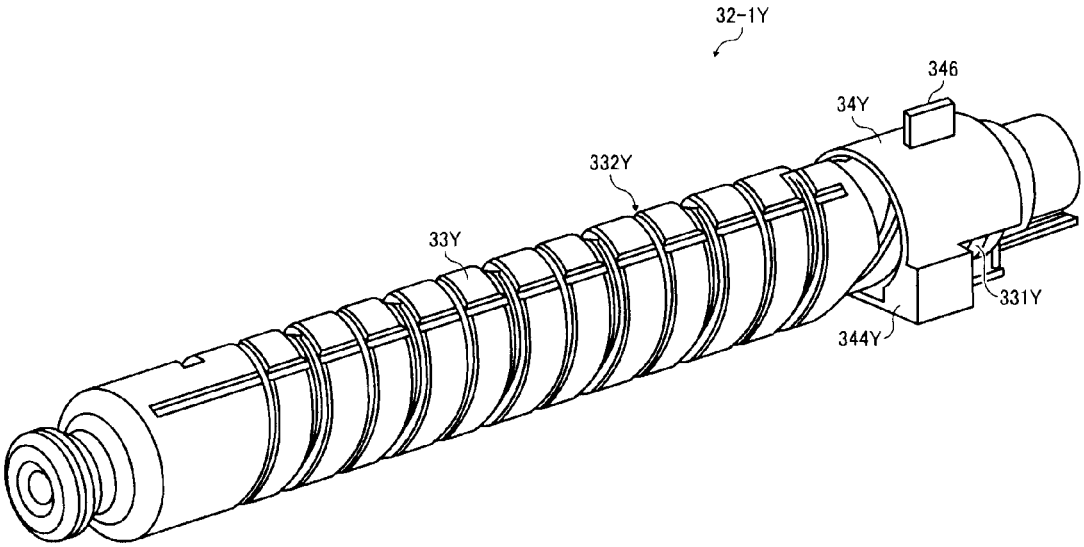
FIG. 9 is a perspective view of a toner container according to a variation.

FIG. 9 is a perspective view that illustrates, as a variation of toner containers, a toner container 32-1Y including a color discrimination projection 346.

In this variation, toner containers 32-1 for other colors similarly have color discrimination projections 346 provided on the top of the respective toner containers 32-1, and the color discrimination projections 346 are different in shape among different colors. In this configuration, the shapes of the openings 201 formed in the toner container mount 31 conform to the shapes of the respective color discrimination projections 346.

With this configuration, even if the toner containers 32-1 are the same or similar in size, the toner container 32-1 does not fit the opening 201 for the wrong color, thus preventing erroneous installation. Additionally, in the configuration in which at least one of the toner containers 32-1 (e.g., black toner container) is larger in size, in particular, external diameter, from others, the color discrimination projection 346 can secure prevention of erroneous installation of smaller toner container 32-1 through the opening 201 for the larger toner container 32-1. More specifically, if the user tries to insert a wrong toner container 32-1 so that the color discrimination projection 346 (upper color discrimination) does not hit the inner cover 200, the guided portion 344 (lower engagement for color discrimination) can prevent the erroneous insertion. By contrast, if the user tries to insert the wrong toner container 32-1 so that the guided portion 344 (lower engagement for color discrimination) does not hit the inner cover 200, the color discrimination projection 346 (upper color discrimination) can prevent the erroneous insertion.

Alternatively, in the configuration in which the toner containers 32-1 are different in size, the color discrimination projection 346 may be provided only on the smaller toner containers 32-1. Because the larger toner container 32 (i.e., black toner container 32K) cannot fit in the opening 201 for any of the smaller toner containers 32-1, it is not necessary to provided the color discrimination projection 346 on the larger toner container 32K.

As described above, the entrance portion of the toner container mount 31 has a shape conforming to the shapes of the lower engagements for color discrimination (guided portions 344) and the upper engagements for color discrimination (projections 346). Although it is not necessary that the entrance (i.e., edge face of the inner cover 200) of the toner container mount 31 strictly conforms to the shape of the color discrimination projection 346, it is preferable that the color discrimination projection 346 engage the toner container mount 31 as close as possible to the entrance. Thus, the erroneous installation of the toner containers can be prevented early.

Additionally, it is preferable that an instruction for the user to align the bottom of the toner container 32 with the bottom of the opening 201 in installation of the toner container 32 be provided on at least one of the image forming apparatus 100 or the toner container 32 itself.

As described above, the image forming apparatus 100 according to the present embodiment includes the image forming units 6, the toner containers 32, the guide rails 41, and the inner cover 200. The four toner containers 32 contain different color toners supplied to the respective image forming units 6 and are removably installable in the image forming apparatus 100. More specifically, the toner containers 32 are horizontally inserted or removed from the toner container mount 31 of the main body of the image forming apparatus 100 through the openings 201 formed in the inner cover 200. The guide rails 41 support the guided portions 344 and guide insertion of the toner container 32 into the toner container mount 31 provided in the main body of the apparatus. The guided portions 344 project laterally in the direction perpendicular to the direction of insertion of the toner container 32 and engage the respective guide rails 41 formed in the toner container mount 31.

Additionally, among the four toner containers 32, the toner container 32K has a capacity greater than that of other toner containers 32Y, 32M, and 32C, and the cross section of the toner container 32K perpendicular to the direction of insertion is greater than that of other toner containers 32Y, 32M, and 32C. The four openings 201 formed in the inner cover 200 are greater in size than the shapes of the respective toner containers 32 including the guided portions 344 to fit the respective toner containers 32. Thus, the shapes of the openings 201 are conformable to the respective guided portions 344. The height H2 of the guided portions 344Y, 344M, and 344C of the toner containers 32Y, 32M, and 32C is greater than the height H1 of the guided portion 344K of the black toner container 32K and is further greater than the height H1' of the portion 210K of the opening 201K through which the guided portion 344K passes.

In the image forming apparatus 100 according to the present embodiment, because the guided portions 344 of any of the three toner containers 32Y, 32M, and 32C other than the black toner container 32K have a vertical length longer than that of the guided portions 344K of the toner container 32K, if the user tries to engage the guided portions 344 of any of the toner containers 32Y, 32M, and 32C with the guide rails 41 for black, the guided portions 344 hit the inner cover 200. Thus, the toner containers 32Y, 32M, and 32C can be prevented from inserting into the portion for dedicated for the black toner container 32K, formed in the toner container mount 31.

Thus, in the present embodiment, color compatibility (color discrimination) of the toner containers are attained with not a projection dedicated for color discrimination but differences in height of existing portions, that is, the guided portions 344 among different colors. Thus, it is not necessary to provide a large projection on the toner containers, thus eliminating the need for increasing the lateral size of the apparatus.

Additionally, when the guided portions 344 are provided on both lateral sides of the toner container 32, and the guided portions 344 may be provided asymmetrically at different heights. With this configuration, the toner container 32 can be guided better than in the configuration in which the guided portion 344 is provided on only one side, and the space between the adjacent toner containers 32 can be used effectively.

Additionally, a toner conveyance member similar to the first conveyance screw 55Y or the second conveyance screw 57Y, such as a conveyance screw including a rotary shaft with a spiral blade or multiple planar blades (fins), or an auger, may be provided inside the toner container 32. With the toner conveyance member provided therein, toner can be transported reliably inside the container body 33 of the toner container 32. In this configuration, vibration and noise can be smaller compared with the configuration in which the container body 33 itself rotates to transport the toner.

The spiral protrusion 332 is formed on the inner circumferential surface of the container body 33. As the container body 33 rotates, the toner contained therein is transported along the spiral protrusion 332. This configuration is advantageous in terms of cost because the number of components is smaller compared with configurations in which a toner conveyance member is provided inside the toner container 32. Additionally, since an external drive force is required to drive the toner conveyance member provided inside the toner container 32, means to prevent leakage of toner between the drive unit and toner container 32 is required. By contrast, rotating the container body 33 itself as in the present embodiment can eliminate the need for prevention against toner leakage.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image forming unit to form an image on an image bearer;

a toner container mount into which first and second toner containers for containing toner are removably insertable horizontally, the second toner container greater than the first toner container in a cross section perpendicular to a direction of insertion of the first and second toner containers, the first and second toner containers each including guided portions projecting laterally on the cross section perpendicular to the direction of insertion of the first and second toner containers, the guided portions positioned at a lower portion of the first and second containers, container guides formed in the toner container mount configured to guide the guided portions of the first and second toner containers inserted into the toner container mount, respectively; and an insertion opening forming member positioned at an entrance of the toner container mount, defining first and second insertion openings through which the first and second toner containers are respectively inserted, the second insertion opening greater than the first insertion opening, wherein the first and second insertion openings include laterally projecting portions to fit the guided portions of the first and second toner containers, respectively, the laterally projecting portion of the first insertion opening has a vertical length longer than that of the laterally projecting portion of the second insertion opening, and the guided portion of the first toner container has a vertical length longer than that of the guided portion of the second toner container.

2. The image forming apparatus according to claim 1, wherein the laterally projecting portion is provided on only one side of each of the first and second insertion openings, and the guided portion is provided on only one side of each of the first and second toner containers.

3. The image forming apparatus according to claim 1, wherein the laterally projecting portion is provided on each lateral side of each of the first and second insertion openings, and the guided portion is provided on each lateral side of each of the first and second toner containers.

4. The image forming apparatus according to claim 1, wherein the first and second insertion openings further comprise upper projecting portions, projecting upward, respectively, the first and second toner containers further include upper projections projecting upward, positioned in leading end portions thereof in the direction of insertion, the upper projecting portions of the first and second insertion openings are different in shape, and the upper projections of the first and second toner containers are different in shape to fit the upper projecting portions of the first and second insertion openings, respectively.

5. The image forming apparatus according to claim 1, wherein each of the first and second toner containers comprises a toner conveyance member positioned therein to transport the toner therein.

6. The image forming apparatus according to claim 1, wherein each of the first and second toner containers further comprises:

a rotary container body having an opening in an end portion thereof and a spiral protrusion protruding inward from an inner circumferential surface of the container body that conveys the toner contained in the container body therealong to the opening of the container body as the container body rotates; and a head portion to hold the container body rotationally, the head portion retained stationary in the toner container mount at a fixed position relative to the image forming apparatus.

7. A set of toner containers for containing toners for use in an image forming apparatus, the set of toner containers comprising:

a first toner container horizontally insertable into a main body of the image forming apparatus, including a guided portion projecting laterally on a cross section perpendicular to a direction of insertion thereof into the apparatus, the guided portion of the first toner container being positioned at a lower portion of the first container; and a second toner container horizontally insertable into a main body of the apparatus, the second toner container greater than the first toner container on the cross section perpendicular to the direction of insertion and including a guided portion projecting laterally on the cross section perpendicular to the direction of insertion, the guided portion of the second toner container being positioned at a lower portion of the second container, wherein the guided portion of the first toner container has a vertical length longer than that of the guided portion of the second toner container, and the first and second toner containers are insertable into the main body through first and second insertion openings formed in the main body of the image forming apparatus, the first and second insertion openings including laterally projecting portions to fit the guided portions of the first and second toner containers, respectively.

* * * * *